US006900730B2

(12) United States Patent
Oliver et al.

(10) Patent No.: US 6,900,730 B2
(45) Date of Patent: May 31, 2005

(54) HEAT SOURCE LOCATOR

(76) Inventors: Keith Oliver, 65 Rocky Cir., Cartersville, GA (US) 30184; Chung T. Cheng, 340 Dewpoint La., Alpharetta, GA (US) 30022

( * ) Notice: Subject to any disclaimer, the term of this patent is extended or adjusted under 35 U.S.C. 154(b) by 0 days.

(21) Appl. No.: 10/038,421

(22) Filed: Jan. 7, 2002

(65) Prior Publication Data

US 2003/0128117 A1 Jul. 10, 2003

(51) Int. Cl.[7] ..... G08B 13/18

(52) U.S. Cl. ..... 340/567; 340/581; 340/584; 340/589; 340/555; 340/573.1

(58) Field of Search ..... 340/567, 555, 340/556, 557, 561, 551, 552, 553, 573.1, 573.2, 589, 573.3, 584, 573.4, 581

(56) References Cited

U.S. PATENT DOCUMENTS 4,758,933 A * 7/1988 Winberg et al. ..... 362/110
5,161,879 A * 11/1992 McDermott ..... 362/206
5,839,821 A * 11/1998 Lezotte ..... 340/567
6,069,557 A * 5/2000 Anglin, Jr. et al. ..... 340/825.34
6,087,660 A * 7/2000 Morris et al. ..... 250/330
6,097,353 A * 8/2000 Melville et al. ..... 345/8

* cited by examiner

*Primary Examiner*—Jeffery Hofsass
*Assistant Examiner*—Daniel Previl
(74) *Attorney, Agent, or Firm*—Baker Donelson

(57) ABSTRACT

A heat source locator (10) is disclosed having an elongated housing (11) in which is mounted a thermal detector (21), an infrared laser (22), a visible laser (23), and a light bar (25) all coupled directly or indirectly to the outputs of a semiconductor (27). The thermal detector (21) is mounted within the housing (11) to sense a thermal input within a field of view FV along a central longitudinal axis LA. The infrared laser (22) is mounted within the housing (11) to transmit an infrared laser beam IRB generally parallel to and closely adjacent the longitudinal axis LA. The visible light (23) is mounted within the housing (11) to transmit a visible light laser beam VB generally parallel to and closely adjacent the longitudinal axis LA. With this construction, a target may be generally located by the thermal detector and the location pinpointed through an illumination of the target by one of the lasers.

15 Claims, 2 Drawing Sheets

Fig. 1
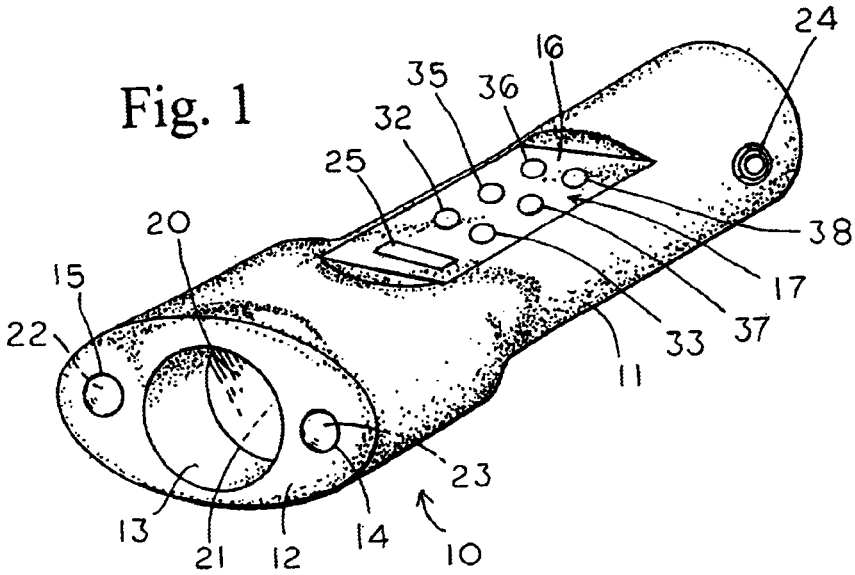
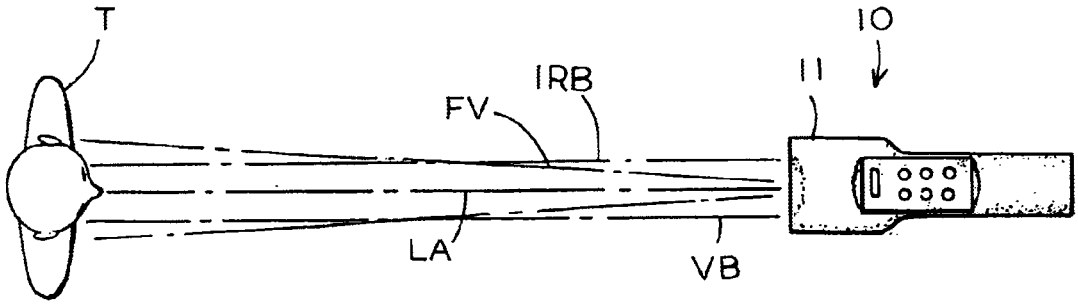
Fig. 2

HEAT SOURCE LOCATOR

TECHNICAL FIELD

This invention relates to locators, and specifically to locators which sense the presence of a heat source.

BACKGROUND OF THE INVENTION

Thermal or heat detectors have previously existed. These devices are often used by hunters in locating wounded animals which have escaped into the underbrush. Military personnel and police officers also utilize these devices in locating individuals attempting to hide from view behind objects or individuals hiding in the dark.

These detectors typically include a thermal sensor in the form of an infrared scanner. The scanner senses the difference in temperature between the subject and its surrounding environment. As the temperature difference is sensed a visual signal is produced through the illumination of a light.

A problem related to these devices has been the pinpointing of the subject once it has been detected by the thermal sensor in a general area. This problem is especially prevalent at night where it may be difficult to tell exactly where the device is pointing when the detection signal is given.

In an attempt to correct this problem operators of these devices have utilized a flashlight which is aimed to illuminate the general area being searched which illuminates the subject with a visible light. The illumination of the subject however enables the subject to realize that its position has been ascertained. Thus, an individual hiding from the police or military may attempt to flee knowing that capture is eminent. Additionally, the production of the light allows the hiding subject to ascertain the source of the light and therefore the searchers position, thus endangering the searcher from attack by the hidden subject. Lastly, the use of a flashlight requires the operator to use both hands, one to operate the device and the other to operate the flashlight.

Accordingly, it is seen that a need remains for a heat source locator which may pinpoint the location of a subject without enabling the subject to determine the location of the searcher or without alerting the subject that its location has been determined. It is to the provision of such therefore that the present invention is primarily directed.

SUMMARY OF THE INVENTION

In a preferred form of the invention a heat source locator to be used in combination with a light viewing device enabling one to view a light outside the visible spectrum of a human is disclosed. The heat source locator comprises thermal detection means for detecting a thermal change within a field of view. The thermal detection means has an axis generally linear centralized within the field of view, and an indicator which indicates the sensing of a heat source. The heat source locator also has light emitting means for generating light having a wavelength outside the visible spectrum of a human. The light beam is aligned generally parallel and closely adjacent to the thermal detection means axis. With this construction, an operator may locate a heat source by sensing the presence of the heat source through the thermal detection means and then locate the position of the located heat source by directing the light beam from the light emitting means while viewing the location with a light viewing device.

In another preferred form of the invention a heat source locator comprises a housing, a thermal detector mounted within the housing to detect a heat source generally along a field of view, and a light emitting device mounted within the housing positioned to emit a beam of light and generally centered along the thermal detector field of view. With this construction an operator may locate a heat source by sensing the presence of the heat source through the thermal detector and then locating the position of the heat source by directing the light beam from the light emitting device

BRIEF DESCRIPTION OF THE DRAWING

FIG. 1 is a perspective of a heat source locator embodying principles of the invention is a preferred form.

FIG. 2 is a schematic view of the heat source locator of FIG. 1 in use.

DETAILED DESCRIPTION

Figure 3:
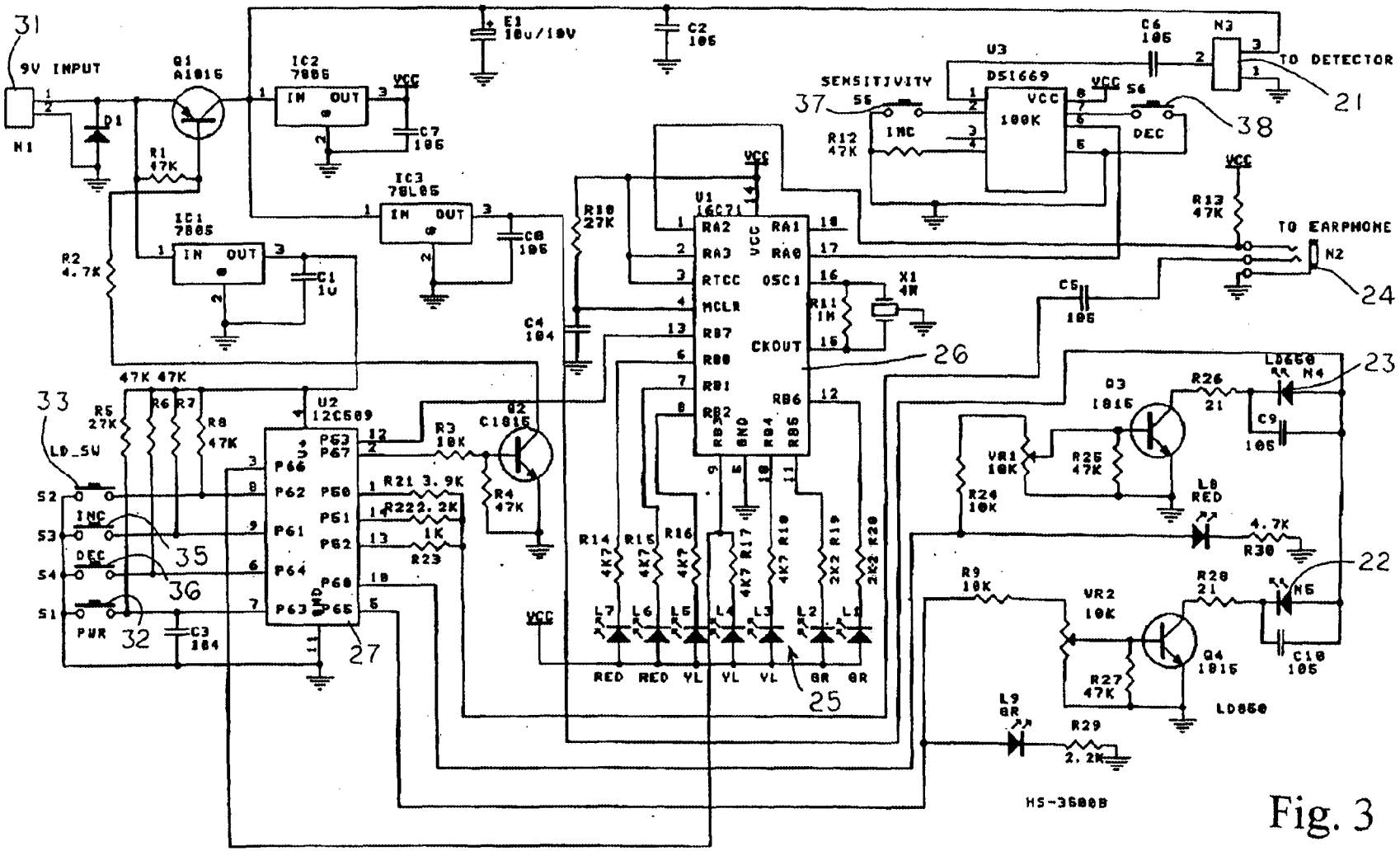
FIG. 3 is a schematic diagram of circuit for the heat source locator of FIG. 1.

With reference next to the drawings, there is shown a heat source locator 10 in a preferred form of the invention. The locator 10 has an elongated housing 11 configured to be easily grasped within an operator's hand. The housing 11 has a front wall 12 with a large central opening 13, a visible light beam opening 14, and an invisible light beam opening 15. The housing also has a top wall 16 having a control panel 17.

The heat source locator 10 also has a thermal detector 21, an infrared laser 22, a visible light laser 23, an earphone jack 24, and a light bar 25 coupled to a microchip 26, all these components in turn are coupled to the outputs of a semiconductor 27. The microchip is preferably a Microchip Corporation model number 970711FQHB04. The semiconductor 27 is preferably a Dallas Semiconductor model number DS1669S-100. The thermal detector 21 may be a model number Siemens AG or Heimen. The infrared laser 22 may be a model number Amstech Incorporated of Alpharetta, Ga. model LM 850 Series. The visible light laser 23 may be a model number Amstech Incorporated of Alpharetta, Ga. model LM 650 Series. The thermal detector 21 is mounted within the housing 11 to sense a thermal input within a field of sensitivity or field of view FV extending through the front wall central opening 13 and focused upon the thermal detector 21 through a lens 20.

The infrared laser 22 is mounted within the housing 11 to transmit an infrared laser beam IRB through the invisible light beam opening 15 in the housing front wall 12. Similarly, the visible laser 23 is mounted within the housing 11 to transmit a visible laser beam VB through the visible light beam opening 14 in the housing front wall 12. A conventional nine volt battery 31 is coupled to the semiconductor 27 which powers the semi-conductor 27, the thermal detector 21, the infrared laser 22, the visible laser 23, an earphone coupled to the earphone jack 24, and the light bar 25. The heat source locator 10 also includes an on/off key 32, an infrared and visible laser on/off key 33, a volume up key 35, a volume down key 36, a sensitivity up key 37 and a sensitivity down key 38, all coupled to the input of the semi-conductor 27 and displayed for operational use upon the control panel 17. The laser on/off key 33 operates so that with the first depression of the key the infrared laser 22 is activated, with the second depression of the key the visible light laser 23 is activated and the infrared laser 22 is deactivated, and with the third depression of the key the visible light laser 23 is deactivated.

The thermal detector 21 has a field of view FV aligned along a longitudinal axis LA extending through the thermal detector 21. The infrared laser 22 and visible laser 23 are positioned to emit their light beams IRB and VB generally parallel to and closely adjacent the longitudinal axis LA of the thermal detector 21.

In use, with the operator may utilize conventional equipment to view light of an infrared wavelength, such as infrared eye goggles model number F5001 made by ITT, Inc. of Roanoke, Va. should the employment of the infrared laser 22 be selected. An operator initiates the operation of the heat source locator 10 by depressing the on/off key 32, which in turn causes the semi-conductor 27 to energize the thermal detector 21. The operator then scans the area in which the operator is attempting to locate a specific heat source, such as a person hiding in the dark, by moving the heat source locator 10 back and forth so as to sweep the field of view of the heat detector 21 across the area to be searched. Once the heat detector 21 senses a change in the perceived heat, through the detection of infrared heat waves, within its field of view FV a signal is transmitted and the microchip 26 energizes the light bar 25 accordingly, thus visually indicating to the operator that a heat source has been located. By continually narrowing the range of the sweeping motion of the heat source locator 10 the operator may point the locator 10 at the heat source. Optionally, the operator may employ the use of an earphone coupled to the earphone jack 24 to provide an audible signal.

Once the heat source is generally located by a constant illumination of the light bar 25 the operator may depress the infrared laser on/off key 33. The depression of the infrared laser on/off key 33 causes the semi-conductor 27 to energize the infrared laser 22. As the infrared beam IRB from the infrared laser 22 closely parallels the longitudinal axis LA of the thermal detector's field of view FV the infrared beam IRB is impinged upon the target heat source. With the use of the infrared viewing equipment the operator thus sees the exact location which falls along the longitudinal axis LA of the heat detector, and assumably the exact location of the targeted heat source.

It should be understood that with the heat source locator used in the just described manner a target may be located and illuminated with a light which is invisible to the target, i.e. light outside the visible spectrum of an animal such as a human. As such, the target is not made aware that its position has been determined. Furthermore, as the light produced by the heat source locator 10 is invisible to the target the location of the operator is not given by the operation of the heat source locator.

Should the operator decide that the use of an invisible light source is not necessary the operator may utilize the visible light laser 23 to pinpoint the position of the target. Here, the procedure is essentially the same as just describe except that the laser on/off key 33 is depressed again so as to energize the visible light laser 23. The visible light laser 23 emits a visible light upon the target, which is assumed to be centered within the field of view of the thermal detector.

It should be understood that while the preferred embodiment shows the use of an infrared laser as an invisible light source, other light sources which produce a light outside the visible spectrum of a human may be used as an equivalent substitute. As such, the term invisible light as used herein is meant to include all light outside the visible spectrum of an animal and especially a human.

The sensitivity of the heat source locator may be adjusted through the operation of the sensitivity up key 37 and sensitivity down key 38. The operation of the sensitivity up key 37 increases the sensitivity of the thermal detector 21 while the operation of the sensitivity down key 38 decreases the sensitivity of the thermal detector 21. Similarly, the volume to the earphone may be increased or decreased through the operation of the volume up or volume down keys 35 and 36, respectively. The earphone jack and semi-conductor may be designed to disable the light bar when an earphone is plugged into the earphone jack, so as to maintain the stealth quality of the device.

It should be understood that in situations where it is irrelevant that the target be illuminated with a visible light the operator may pinpoint the target's location through the energization of the visible light laser 23. To energize the visible light laser 23 the operator merely depresses the laser on/off key 33 which signals the semi-conductor 27 to energize the visible light laser 23.

A heat locator embodying principles of the present invention is incorporated by the device presently sold by Amstech Incorporated of Alpharetta, Ga. under the trade name HEAT-SEEKER model number HS3500C, the teachings of which are incorporated herein.

It thus is seen that a heat source detector is now provided which does not disclose the position of the operator to the target and which does not allow the target to become aware that his position has been determined by the operator. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A heat source locator to be used in combination with a light viewing device enabling one to view a light outside the visible spectrum of a human, the heat source locator comprising:

thermal detection means for detecting a thermal change within a field of view, said thermal detection means having a central axis within said field of view and an indicator which indicates the sensing of a heat source; and light emitting means for generating light, said light emitting means having a light beam of a wavelength outside the visible spectrum of a human, said light beam being aligned generally parallel and closely adjacent to said thermal detection means axis;

whereby an operator locates a heat source by sensing the presence of the heat source through the thermal detection means and then locating the position of the located heat source by directing the light beam from the light emitting means while viewing the location with a light viewing device.

2. The heat source locator of claim 1 further comprising a second light emitting means, said second light emitting means generating a beam of light in a visible spectrum and being aligned generally parallel and closely adjacent to said axis of said thermal detection means.

3. The heat source locator of claim 1 wherein said thermal detection means produces a visual indication of the sensing of a heat source.

4. The heat source locator of claim 1 wherein said thermal detection means produces an audible sound of the sensing of a heat source.

5. The heat source locator of claim 4 wherein said thermal detection means includes an earpiece speaker.

6. A heat source locator comprising;

a housing;

a thermal detector mounted within said housing to detect a heat source generally along a field of view; and a light emitting device mounted within said housing positioned to emit a beam of light having a wavelength outside the visible spectrum of a human and generally centered along said thermal detector field of view;

whereby an operator locates a heat source by sensing the presence of the heat source through the thermal detector and then locating the position of the heat source by directing the light beam from the light emitting device while viewing such with a light viewing device adapted to view the emitted wavelength.

7. The heat source locator of claim 6 further comprising a second light emitting means, said second light emitting means generating a beam of light in a visible spectrum and being aligned generally parallel and closely adjacent to said thermal detection means linear direction of sensitivity.

8. The heat source locator of claim 6 wherein said thermal detection means produces a visual indication of the sensing of a heat source.

9. The heat source locator of claim 6 wherein said thermal detection means produces an audible sound of the sensing of a heat source.

10. The heat source locator of claim 9 wherein said thermal detection means includes an earpiece speaker.

11. A heat source locator system comprising;

a thermal detector having a beam of sensitivity along a central axis;

a light emitting device positioned to produce a beam of light having a wavelength outside the visible spectrum of a human and aligned generally along said thermal detector beam of sensitivity central axis; and a light viewing device adapted to enable a viewer to view the light produced by said light emitting device, whereby an operator locates a heat source by sensing the presence of the heat source through the thermal detector and then locating the position of the heat source by directing the light beam from the light emitting device while viewing the location with the light viewing device.

12. The heat source locator of claim 11 further comprising a second light emitting means, said second light emitting means generating a beam of light in a visible spectrum and being aligned generally parallel and closely adjacent to said thermal detection means linear direction of sensitivity.

13. The heat source locator of claim 11 wherein said thermal detection means produces a visual indication of the sensing of a heat source.

14. The heat source locator of claim 11 wherein said thermal detection means produces an audible sound of the sensing of a heat source.

15. The heat source locator of claim 14 wherein said thermal detection means includes an earpiece speaker.

* * * * *